US007441815B2

(12) United States Patent
Umino

(10) Patent No.: US 7,441,815 B2
(45) Date of Patent: Oct. 28, 2008

(54) DOOR LOCK DEVICE

(75) Inventor: Masaaki Umino, Yamanashi (JP)

(73) Assignees: Mitsui Mining & Smelting Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 183 days.

(21) Appl. No.: 11/011,097

(22) Filed: Dec. 15, 2004

(65) Prior Publication Data

US 2005/0140149 A1 Jun. 30, 2005

(30) Foreign Application Priority Data

Dec. 25, 2003 (JP) ..... 2003-430308
Mar. 31, 2004 (JP) ..... 2004-104941

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS 2,735,289 A * 2/1956 Trammell ..... 70/181
3,205,727 A * 9/1965 Sevrence ..... 74/500.5
3,247,691 A * 4/1966 Martin ..... 70/181
3,525,545 A * 8/1970 Leslie ..... 292/216
3,781,045 A * 12/1973 Watermann ..... 292/216
3,840,258 A * 10/1974 Brackmann ..... 292/216
4,169,620 A * 10/1979 Pacura ..... 292/347
5,419,597 A * 5/1995 Brackmann et al. ..... 292/201
5,427,421 A 6/1995 Hamaguchi
5,577,782 A 11/1996 Johnson et al.
5,605,363 A * 2/1997 Kapes ..... 292/196
5,681,068 A 10/1997 Kleefeldt et al.
5,715,713 A * 2/1998 Aubry et al. ..... 70/277
6,142,035 A * 11/2000 Babatz et al. ..... 74/501.6
6,375,234 B1 * 4/2002 Brackmann et al. ..... 292/1
6,913,298 B2 * 7/2005 Inoue ..... 292/216
7,108,302 B2 * 9/2006 Zingelmann ..... 292/337
2002/0074808 A1 6/2002 Inoue

FOREIGN PATENT DOCUMENTS

DE 101 12 782 A1 10/2001
EP 0 285 412 A2 10/1988
JP 07-054528 A 2/1995
JP 2000-027513 A 1/2000
JP 2001-262905 A 9/2001
WO WO 00/75468 A1 12/2000

* cited by examiner

*Primary Examiner*—Carlos Lugo
(74) *Attorney, Agent, or Firm*—Sughrue Mion, PLLC

(57) ABSTRACT

When an inside lock button is operated for locking, an inner wire of a wire cable is drawn into an outer tube of the wire cable so that a lock lever shifts from an unlock state to a lock state, whereas when the inside lock button is operated for unlocking, the inner wire of the wire cable is pushed out of the outer tube of the wire cable so that the lock lever shifts from a lock state to an unlock state.

5 Claims, 14 Drawing Sheets

DOOR LOCK DEVICE

BACKGROUND OF THE INVENTION

1) Field of the Invention

The present invention relates to a door lock device for a vehicle, and more particularly, to a door lock device that switches from an unlock state to a lock state of a door in response to an operation of an inside lock button.

2) Description of the Related Art

Conventionally, a vehicle, such as four-wheeled vehicle, generally has a door lock device provided between an outside handle disposed for a door and a latch mechanism. The latch mechanism usually has a latch and a ratchet, and is so configured that when a door is closed relative to the vehicle body, the latch hold a striker on the vehicle body side by meshing, and the ratchet keeps the meshing state between the latch and the striker, whereby the door is kept in closed state relative to the vehicle body. The door lock device has a lock mechanism which switches between an unlock state and a lock state in response to a key operation on a key cylinder provided in the door on the interior side or by an operation on an inside lock button provided in the door on the interior side. Linkages between the lock mechanism and the key cylinder, and between the lock mechanism and the inside lock button are respectively accomplished by wire cables (see for example, Japanese Patent Application Laid-Open Publication No. 2001-262905).

The door lock device in an unlock state permits a door-opening operation by the outside handle and transmits it to the ratchet, and when the ratchet engages the latch, the door lock device cancels the engaging state of the ratchet to the latch. As a result, the meshed state between the latch and the striker is also canceled, so that a door-opening operation relative to the vehicle body is enabled.

The door lock device in a lock state disables a door-opening operation by the outside handle to disable transmission to the ratchet. As a result, even when the outside handle is operated, the meshed state between the latch and the striker is kept, to allow locking of the vehicle.

On the other hand, the door lock device in a lock state cancels the lock state and enables a door-opening operation by the inside handle to allow transmission to the ratchet, when a door-opening operation is made with the inside handle, while it serves to cancel this engaged state between the latch and the ratchet when the ratchet engages the latch. As a result, the meshed state between the latch and the striker is also canceled, so that a door-opening operation relative to the vehicle body is enabled.

According to the above door lock device, when the inside lock button is operated for locking, an inner wire of a wire cable is pushed out of an outer tube of the wire cable, and the lock mechanism transits from an unlock state to a lock state. When the inside lock button is operated for unlocking, the inner wire of the wire cable is drawn into the outer tube of the wire cable, and the lock mechanism transits from a lock state to an unlock state.

In the above door lock device, since the lock mechanism transits from a lock state to an unlock state just by drawing in the inner wire of the wire cable, the lock mechanism will transit from a lock state to an unlock state in response to a drawing action exerted on the inner wire of the wire cable, for example, by pulling or pushing the wire cable integrally with the outer tube from outside of a door by suitable means. This is unfavorable in respect of the antitheft ability.

SUMMARY OF THE INVENTION

It is an object of the present invention to solve at least the above problems in the conventional technology.

A door lock device according to one aspect of the present invention includes a ratchet lever that is engaged with a ratchet that is in abutting engagement with a latch, and releases the abutting engagement; a lock lever that shifts between an unlock position where transmission of a door opening operation by an outside handle to the ratchet lever is enabled and a lock position where the transmission of the door opening operation by the outside handle to the ratchet lever is disabled; and an inside lock button connected to an inner wire of a wire cable that causes the lock lever to shift from the unlock position to the lock position with an operation of locking, and causes the lock lever to shift from the lock position to the unlock position with an operation of unlocking. When the inside lock button is operated for locking, the inner wire of the wire cable is drawn into an outer tube of the wire cable so that the lock lever shifts from the unlock state to the lock state; and when the inside lock button is operated for unlocking, the inner wire of the wire cable is pushed out of the outer tube of the wire cable so that the lock lever shifts from the lock state to the unlock state.

The other objects, features, and advantages of the present invention are specifically set forth in or will become apparent from the following detailed description of the invention when read in conjunction with the accompanying drawings.

DETAILED DESCRIPTION

Exemplary embodiments for a door lock device according to the present invention will be explained in detail with reference to the accompanying drawings. It is to be noted that the present invention is not restricted by these exemplary embodiments.

Figure 1:
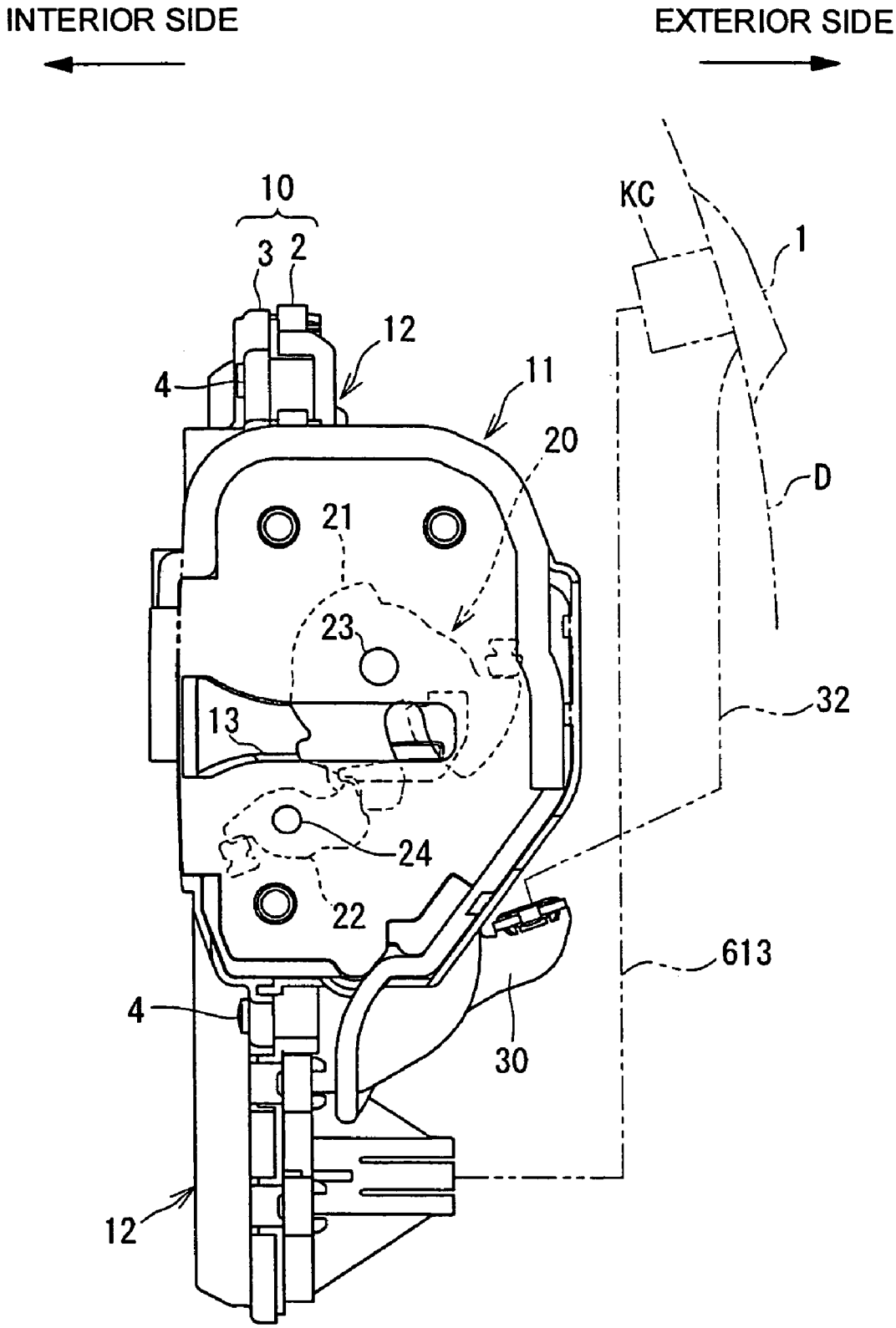
FIG. 1 is a view of a door lock device embodying the present invention, viewed from the rear side of the vehicle.
Figure 2:
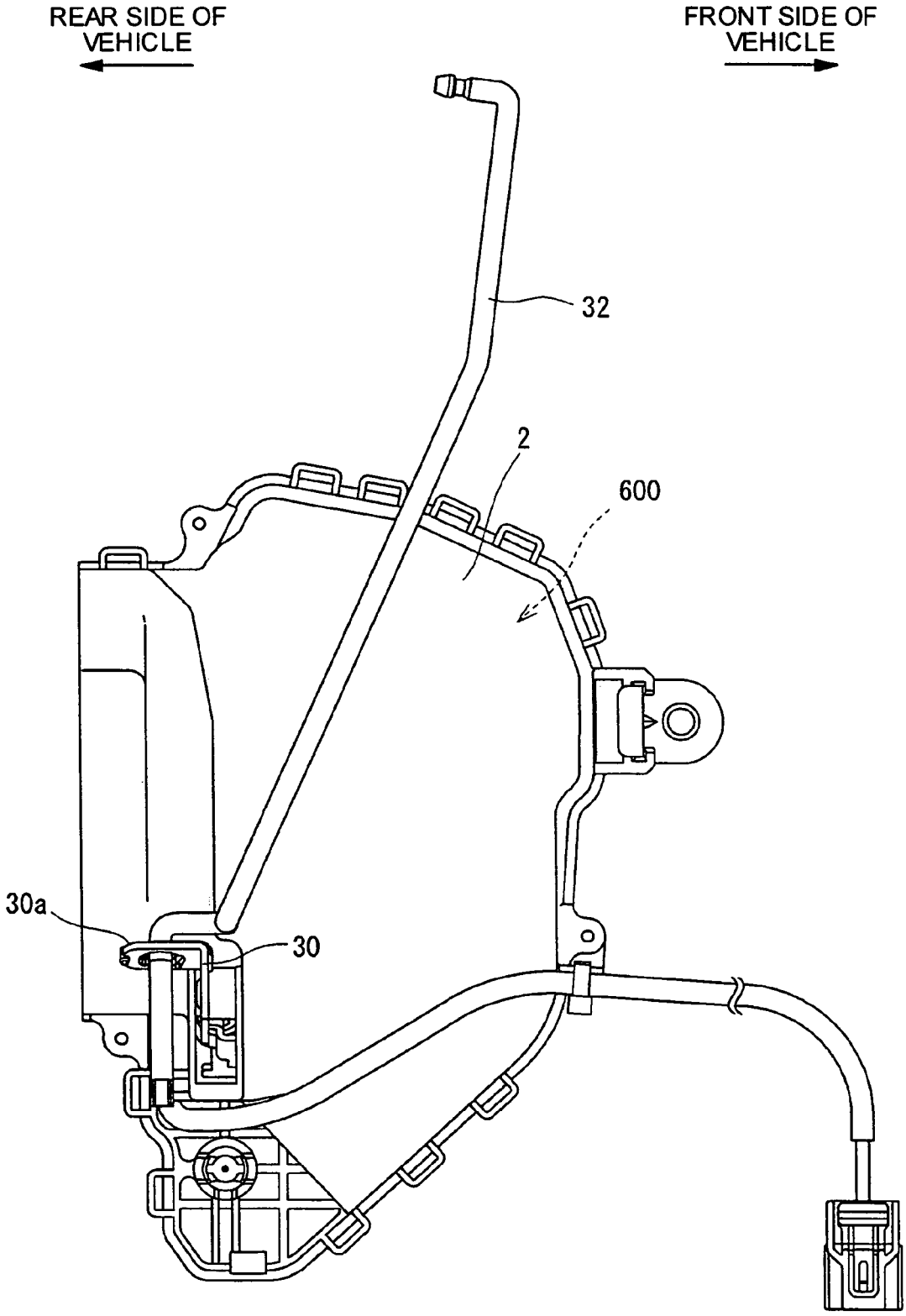
FIG. 2 is a view of the door lock device shown in FIG. 1, viewed from the exterior side.
Figure 3:
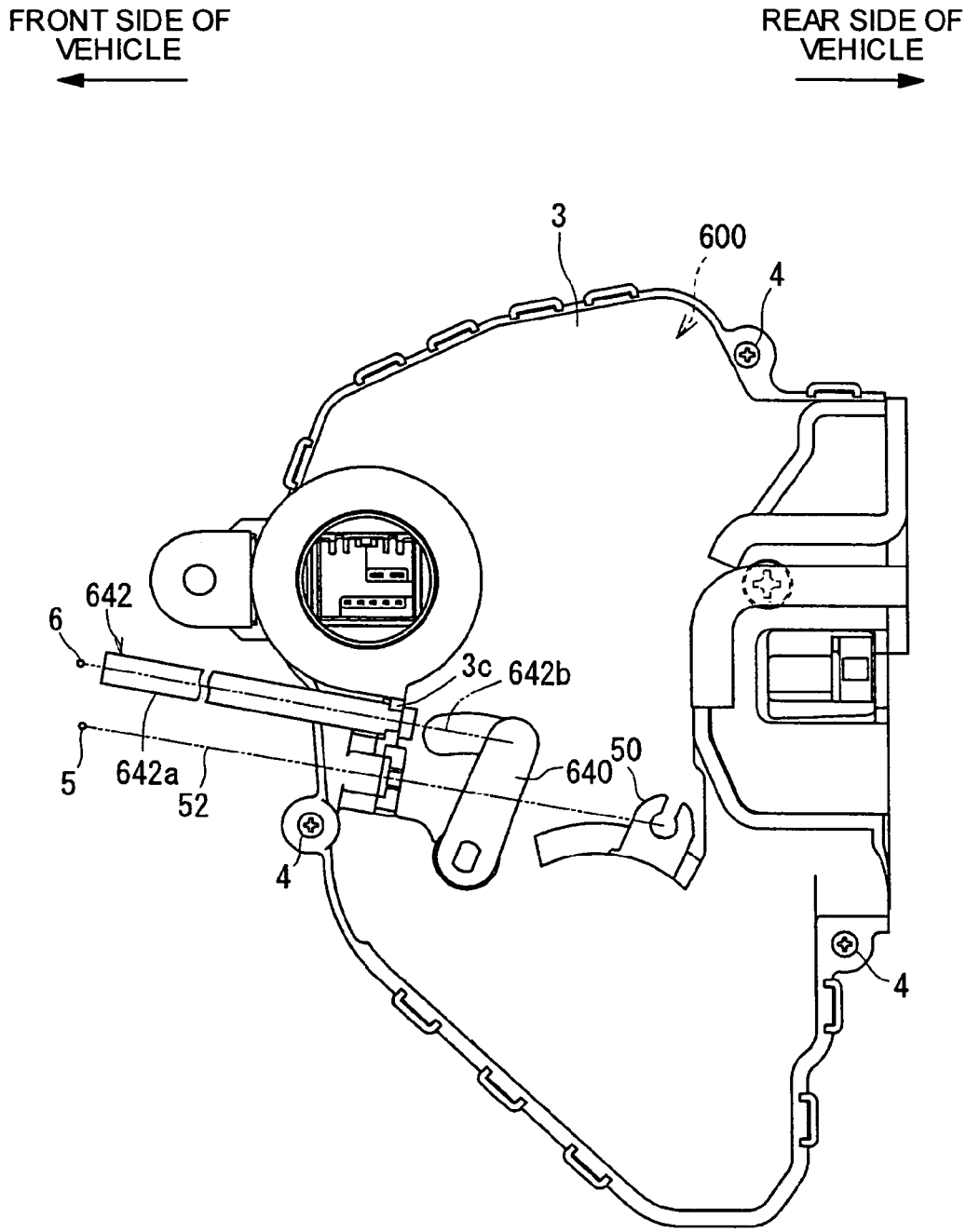
FIG. 3 is a view of the door lock device shown in FIG. 1, viewed from the interior side.

FIGS. 1 to 3 depict a door lock device which is an exemplary embodiment of the present invention. The door lock device illustrated herein is provided between an outside handle 1 and a latch mechanism 20 in a side door of front hinge type disposed on the right of front seat in a four-wheeled vehicle (door D on the side of the driving seat in the case of a right-hand-drive car), and includes a main casing 2 and a sub casing 3. These main casing 2 and sub casing 3 each formed of, for example, plastic are first joined with each other and then fastened with each other by a fastening unit 4 such as screw, thereby forming a housing 10. The joining surface between the main casing 2 and the sub casing 3 is intervened by an O-ring (not shown) to secure desired water tightness.

The housing 10 formed of these main casing 2 and sub casing 3 includes a latch mechanism accommodating unit 11 extending along the right-and-left direction of the door D and a lock mechanism accommodating unit 12 extending along the fore-and-aft direction of the door D from an end of the latch mechanism accommodating unit 11 located on the interior side, and has a nearly L shape when viewed from above.

The latch mechanism accommodating unit 11 has a horizontal notched groove 13 extending nearly horizontally from the interior side to the exterior side at a position which is nearly the mid point of the height direction, and accommodates a latch mechanism 20.

Figure 4A:
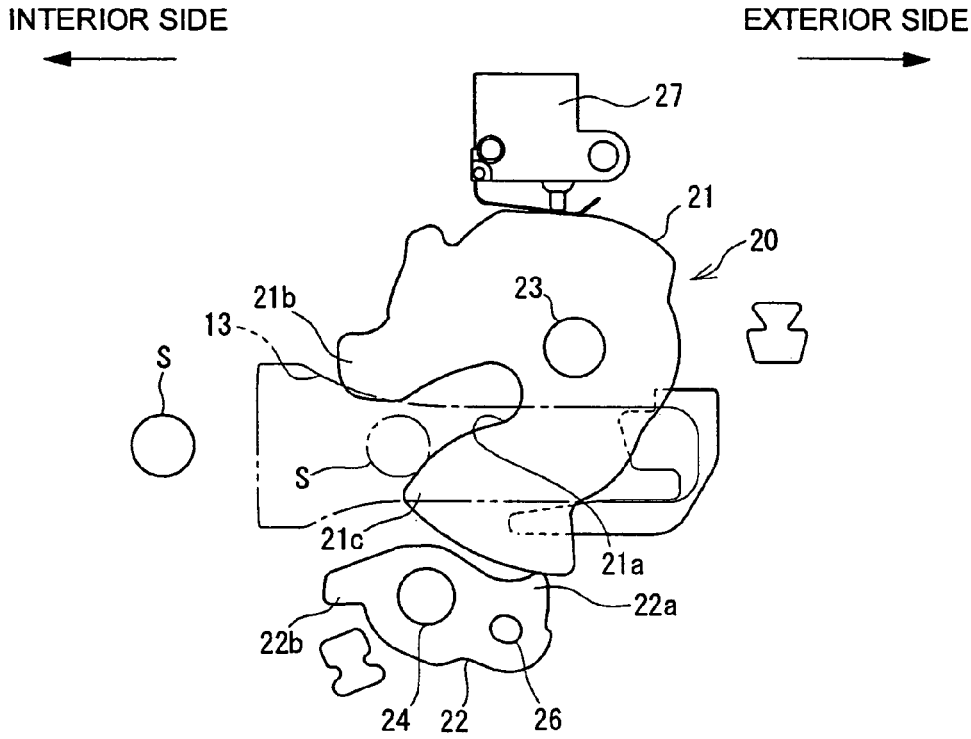
FIG. 4A is a conceptual view of a latch mechanism in an open state.
Figure 4B:
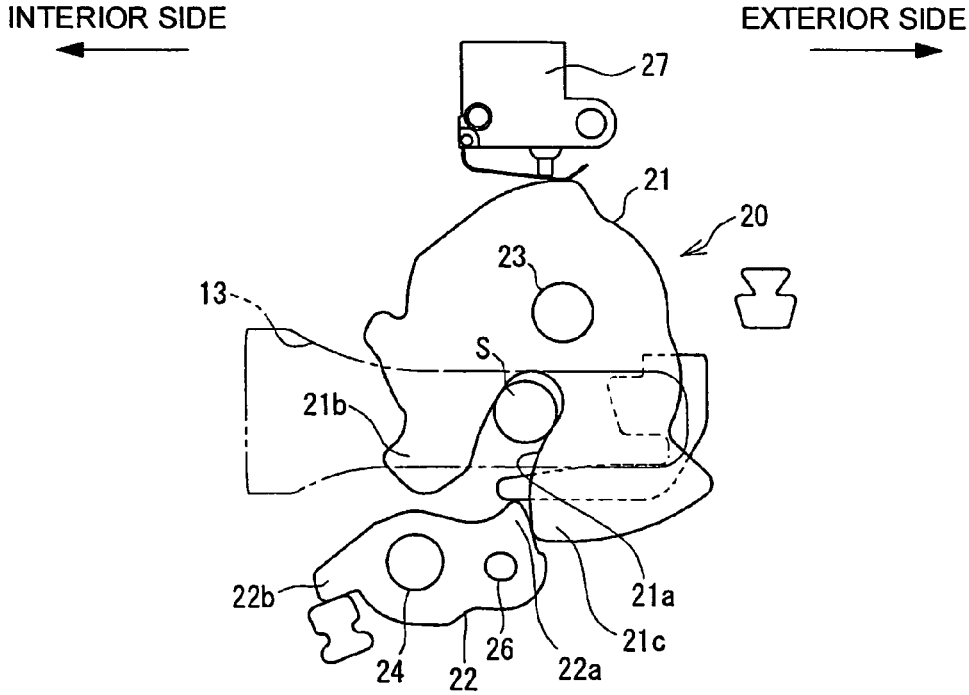
FIG. 4B is a conceptual view of a latch mechanism in a half-latch state.
Figure 4C:
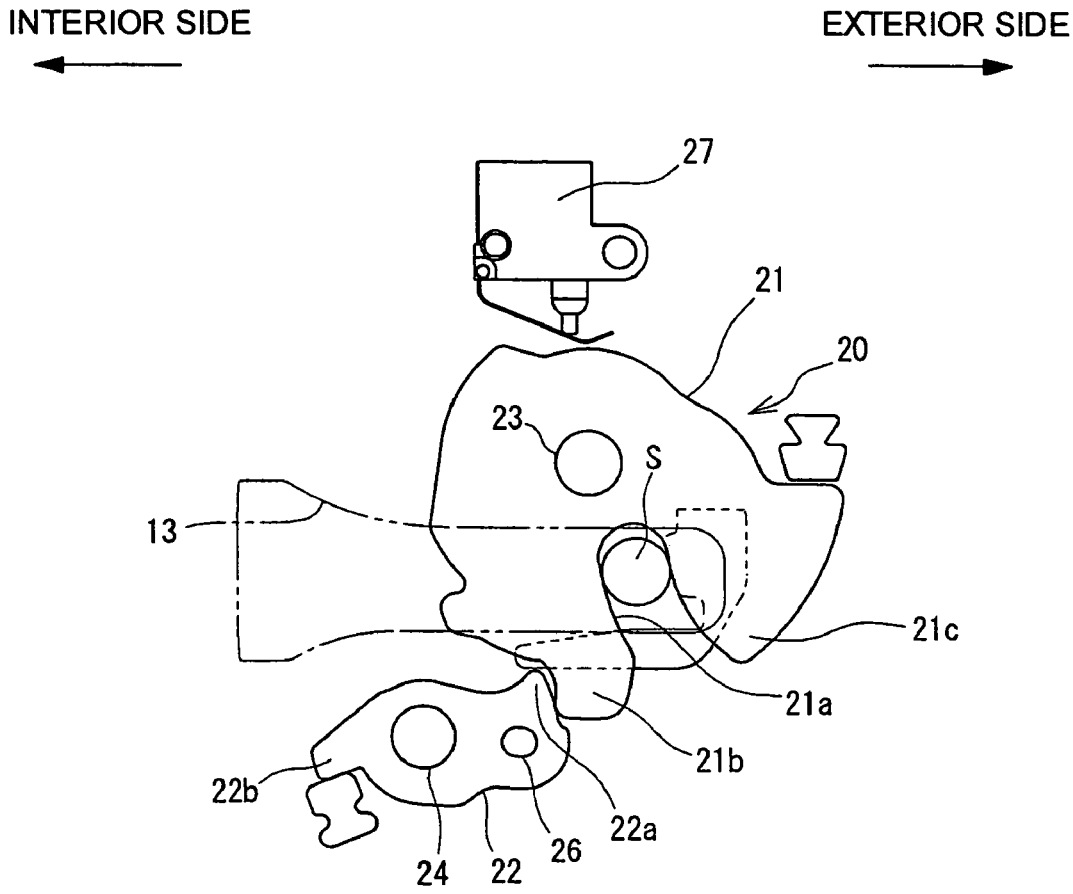
FIG. 4C is a conceptual view of a latch mechanism in a full-latch state.

As is the same with those described above, the latch mechanism 20 is provided for retaining by meshing engagement, a striker S disposed on the vehicle body side of the four-wheeled vehicle, and includes a latch 21 and a ratchet 22 as shown in FIGS. 4A to 4C.

The latch 21 is disposed to allow rotation about a latch shaft 23 extending nearly horizontal along the fore-and-aft direction of the vehicle body, at a position higher than the horizontal notch groove 12 of the latch mechanism accommodating unit 11, and includes a meshing groove 21*a*, a hook unit 21*b* and a latch unit 21*c*.

The meshing groove 21*a* extends from the outer periphery of the latch 21 to the latch shaft 23, and is wide enough to accommodate the striker S.

The hook unit 21*b* is situated closer to the interior than the meshing groove 21*a* when the meshing groove 21*a* is opened downward. The hook unit 21*b* is so configured that it will stop at a position where the horizontal notch groove 13 is opened (open position) when the latch 21 is rotated clockwise as shown in FIG. 4A, whereas it will stop at a position where it traverses the horizontal notch groove 13 of the latch mechanism accommodating unit 11 (latch position) when the latch 21 is rotated counterclockwise as shown in FIG. 4C.

The latch unit 21*c* is situated closer to the exterior than the meshing groove 21*a* when the meshing groove 21*a* is opened downward. The latch unit 21*c* is so configured that it will stop at a position where it transverses the horizontal notch groove 13 and gradually slopes upward toward back (exterior side) of the horizontal notch groove 13, when the latch 21 is rotated clockwise as shown in FIG. 4A. Although not clearly depicted, between the latch 21 and the latch mechanism accommodating unit 11 is provided a latch spring (not shown) that always urges the latch 21 clockwise.

The ratchet 22 is provided at a position lower than the horizontal notch groove 13 of the latch mechanism accommodating unit 11 and closer to the interior than the latch axis 23, to allow rotation about a ratchet shaft 24 extending nearly horizontally along the fore-and-aft direction of the vehicle body situated, and has an engaging unit 22*a* and an acting unit 22*b*.

The engaging unit 22*a* extends in an outward radial direction from the ratchet shaft 24 toward the exterior, and is capable of engaging the hook unit 21*b* and the latch unit 21*c* of the latch 21 as described above via a protruding end surface when the ratchet 22 rotates counterclockwise in FIGS. 4A to 4C.

The acting unit 22*b* extends in an outward radial direction from the ratchet shaft 24 toward the interior. The ratchet 22 is provided with a ratchet lever 25 which rotates about the axial center of the ratchet shaft 24 together with the ratchet 22, at a position of front side of the vehicle. The ratchet lever 25 has an abutting unit 25*a* extending from the ratchet shaft 24 in the same direction with the acting unit 22*b* of the ratchet 22 before bent toward the front side of the vehicle, and an operation end 25*b* further extending in the direction of front side of the vehicle from the abutting unit 25*a* before bent toward the interior of the vehicle. The ratchet lever 25 is coupled with the ratchet 22 by means of a coupling pin 26. A lower part of the abutting unit 25*a* is bent toward the interior of the vehicle. Between the ratchet 22 and the latch mechanism accommodating unit 11 is provided a ratchet spring (not shown) that always urges the ratchet 22 counterclockwise in FIGS. 4A to 4C.

In addition, above the latch 21 is disposed a switch 27 for detecting position of the latch 21. An armature of the switch 27 slidably contacts with an outer periphery of the latch 21, and detects that the latch 21 is in a latch position upon leaving of the latch 21 from the outer periphery and illuminates an interior lamp of the vehicle (not shown) or the like when the latch 21 is in positions other than the latch position (for example, open position, half-latch position).

In the latch mechanism 20 configured as described above, when the door D is in an opened state relative to the vehicle body, the latch 21 is placed in an open position as shown in FIG. 4A and the interior lamp of the vehicle illuminates. When the door D is operated for closing from this state, the striker S provided on the side of vehicle body enters the horizontal notch groove 13 of the latch mechanism accommodating unit 11, and then the striker S comes into contact with the latch unit 21*c* of the latch 21. As a result, the latch 21 rotates counterclockwise in FIGS. 4A to 4C against the elastic force of the latch spring (not shown). During this action, a protruding end surface of the engaging unit 22*a* comes into slidable contact with the outer periphery of the latch 21 due to the elastic force of the ratchet spring (not shown), so that the ratchet 22 appropriately rotates about the axial center of the ratchet shaft 24 depending on the outer peripheral shape of the latch 21.

When the door D is further operated for closing from the above state, the amount of entry of the striker S with respect to the horizontal notch groove 13 gradually increases, and hence the latch 21 further rotates counterclockwise. Eventually, the engaging unit 22*a* of the ratchet 22 will reach the meshing groove 21*a* of the latch 21, as shown in FIG. 4B. In this state, since the latch unit 21*c* of the latch 21 abuts the engaging unit 22*a* of the ratchet 22, clockwise rotation of the latch 21 is prevented against elastic resilience of the latch spring (not shown). Additionally, since the hook unit 21*b* of the latch 21 is disposed to traverse the horizontal notch groove 13, the striker S is prevented from moving to leave the horizontal notch groove 13 by the hook unit 21*b*, or in other words, opening operation of the door D relative to the vehicle body is prevented (half-latch state).

When the door D is further operated for closing from the above half-latch state, the latch 21 further rotates counterclockwise via the latch unit 21*c* due to the striker S entering the horizontal notch groove 13, and the striker S reaches back (exterior side) of the horizontal notch groove 13. During this action, the ratchet 22 rotates clockwise in FIGS. 4A to 4C against the elastic force of the ratchet spring (not shown) as the hook unit 21*b* of the latch 21 comes into abutment of the engaging unit 22*a*, and then immediately becomes rotating counterclockwise due to elastic resilience of the ratchet spring (not shown) upon passage of the hook unit 21*b* of the latch 21. As a result, as shown in FIG. 4C, the hook unit 21*b* of the latch 21 comes into abutment with the engaging unit 22*a* of the ratchet 22, so that the latch 21 is prevented from rotating clockwise against elastic resilience of the latch spring (not shown). Also in this state, since the hook unit 21*b* of the latch 21 is placed to traverse the horizontal notch groove 13, the striker S is prevented from moving in the direction of leaving from the back (exterior side) of the horizontal notch groove 13 by the hook unit 21*b*, resulting that the door D is kept closed relative to the vehicle body (full-latch state), and the interior lamp of the vehicle illuminates.

Furthermore, when the acting unit 22*b* or the abutting unit 25*a* of the ratchet lever 25 is rotated clockwise in FIGS. 4A to 4C against the elastic force of the ratchet spring (not shown) from the above full-latch state, the engaging state by abutment between the hook unit 21*b* of the latch 21 and the engaging unit 22*a* of the ratchet 22 is canceled, so that the latch 21 rotates clockwise in FIGS. 4A to 4C by elastic resilience of the latch spring (not shown). As a result, as shown in FIG. 4A, the horizontal notch groove 13 is opened, the striker S becomes able to move in the direction of leaving the horizontal notch groove 13, the door D can be operated for opening relative to the vehicle body, and the interior lamp of the vehicle illuminates.

On the other hand, the lock mechanism accommodating unit 12 of the housing 10 accommodates, as shown in FIGS. 1 to 3, an open lever 30, a link lever 40, an inner handle lever 50 and a lock mechanism 600.

Figure 5A:
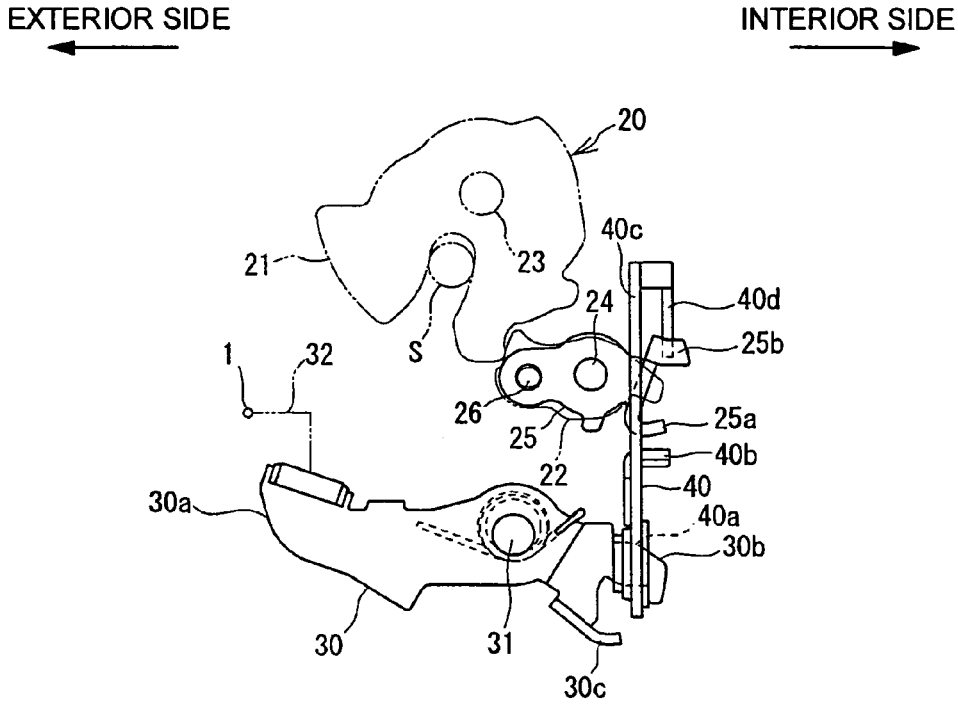
FIG. 5A is a conceptual view representing a relationship between an open lever and a link lever in an initial state.
Figure 5B:
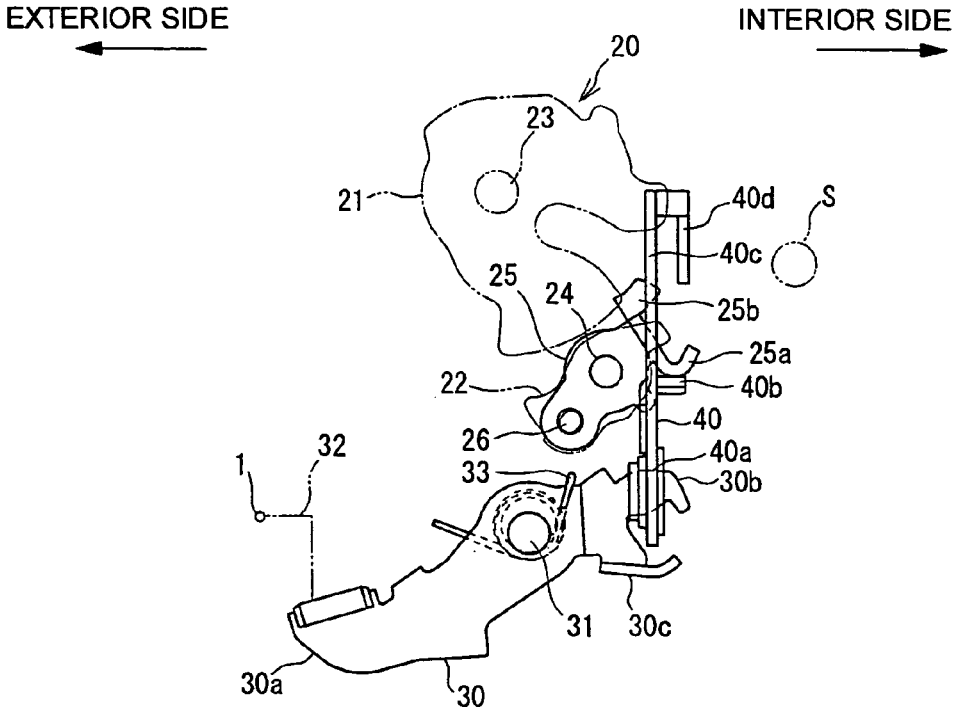
FIG. 5B is a conceptual view representing a relationship between the open lever and the link lever when an out handle is operated for opening.

The open lever 30 is provided to be rotatable about an open lever shaft 31 extending nearly horizontally along the fore-and-aft direction of the vehicle body, at a position lower than the ratchet 22 of the latch mechanism 20 as shown in FIGS. 5A and 5B, and has an opening application end 30*a*, an opening operation end 30*b*, and a pressure receiving unit 30*c*.

The opening application end 30*a* extends in an outward radial direction from the open lever shaft 31 toward the exterior side, and its extended end portion protrudes outside the housing 10. In this opening application end 30*a*, the portion protruding outside the housing 10 is connected with an outside handle linking unit 32 such as a link for linking with the outside handle 1 provided for the door D. More specifically, the outside handle linking unit 32 is connected such that when the outside handle 1 is operated for door opening, the open lever 30 rotates counterclockwise in FIGS. 5A and 5B.

The opening operation end 30*b* extends in an outward radial direction from the open lever shaft 31 toward the interior side, as shown in FIGS. 5A and 5B, and its extended end portion is situated below the abutting unit 25*a* in the ratchet lever 25 inside the housing 10.

The pressure receiving unit 30*c* is bent forward from the lower line of the open lever 30, and situated below the opening operation end 30*b*. Between the open lever 30 and the lock mechanism accommodating unit 12, an open lever spring 33 that always urges the open lever 30 clockwise in FIGS. 5A and 5B is provided.

The opening operation end 30*b* of the open lever 30 is attached with a link lever 40. The link lever 40 has an attaching hole 40*a* at its proximal end, as shown in FIGS. 5A to 6B, and by letting the opening operation end 30*b* of the open lever 30 penetrate through the attaching hole 40*a*, the link lever 40 is borne to be able to move vertically together with the opening operation end 30*b* and able to swing about the axial center along the right-and-left direction of the vehicle body relative to the opening operation end 30*b*. This link lever 40 includes a ratchet driving unit 40*b*, a panic lever coupling unit 40*c* and a lock preventing unit 40*d*.

The ratchet driving unit 40*b* extends in an outward radial direction from the axial center of the attaching hole 40*a* to the abutting unit 25*a* of the ratchet lever 25, and able to push the abutting unit 25*a* of the ratchet lever 25 by upward motion of the link lever 40.

The panic lever coupling unit 40*c* extends in an outward radial direction from the axial center of the attaching hole 40*a* to a lateral side of the operation end 25*b* of the ratchet lever 25 and is formed with a coupling slot 40*e* at its extended end portion.

The lock preventing unit 40*d* extends toward the rear side of the vehicle from a lateral side of the panic lever coupling unit 40*c*, and when the latch 21 is in an open position, the lock preventing unit 40*d* neighbors the operation end 25*b* of the ratchet lever 25 to prevent the link lever 40 from swinging.

The inner handle lever 50 is disposed below the open lever 30 to be able to swing via an inner lever shaft 51 extending nearly horizontally along the right-and-left direction of the vehicle body, and has an inner application end 50*a* and an operation end 50*b*.

The inner application end 50*a* extends upward from the inner lever shaft 51, and its extended end protrudes outside the housing 10. In this inner application end 50*a*, the portion protruding outside the housing 10 is connected with an inside handle linking unit 52 such as link or wire for linking with the inside handle 5 disposed on the interior side of the door D. More specifically, the inside handle linking unit 52 is connected in such a manner that when the inside handle 5 is operated for opening the door, the inner handle lever 50 will swing counterclockwise in FIG. 3.

In the extended portion of the inner application end 50*a*, a one-motion lever coupling hole 50*c* is formed to which a one-motion lever 53 is attached. The one-motion lever 53 extends in arc shape toward the front side of the vehicle from the inner application end 50*a* centered at the inner lever shaft 51, and is formed with a shaft unit 53*a* and an abutting unit 53*b* at its proximal end. The shaft unit 53*a* is a portion to be rotatably mounted to the one-motion lever coupling hole 50*c* of the inner application end 50*a*, and the abutting unit 53*b* is a portion abutting a lateral face of the inner application end 50*a*. Between the one-motion lever 53 and the inner application end 50*a*, a one-motion spring 54 that urges the abutting unit 53*b* of the one-motion lever 53 to abut a lateral face of the inner application end 50*a* is disposed.

The operation end 50*b* is a portion extending to incline downward toward the rear side of the vehicle from the inner lever shaft 51, to which a one-motion link 56 is attached by a rivet 55 to be movable upward. The operation end 50*b* is formed with a pushing unit 50*d* in bent manner on the exterior side, which pushing unit 50*d* will come into abutment with the pressure receiving unit 30*c* of the open lever 30 to push the same when the inner handle lever 50 is swung counterclockwise in FIGS. 6A and 6B.

Figure 6A:
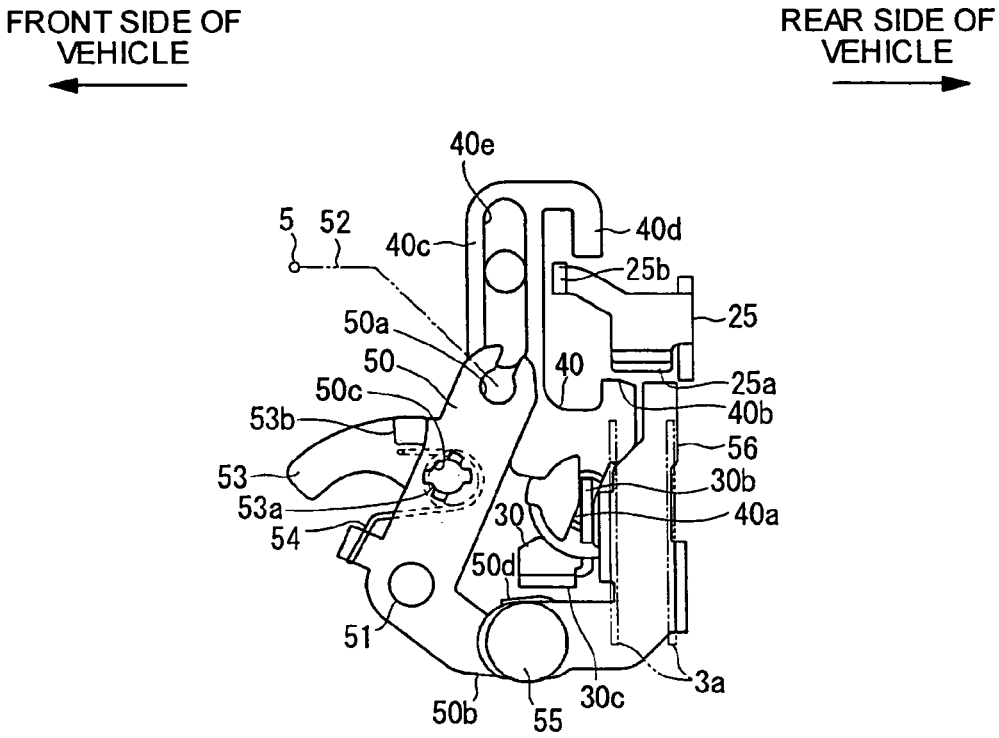
FIG. 6A is a conceptual view representing a relationship between an inner handle lever and a link lever in an initial state.
Figure 6B:
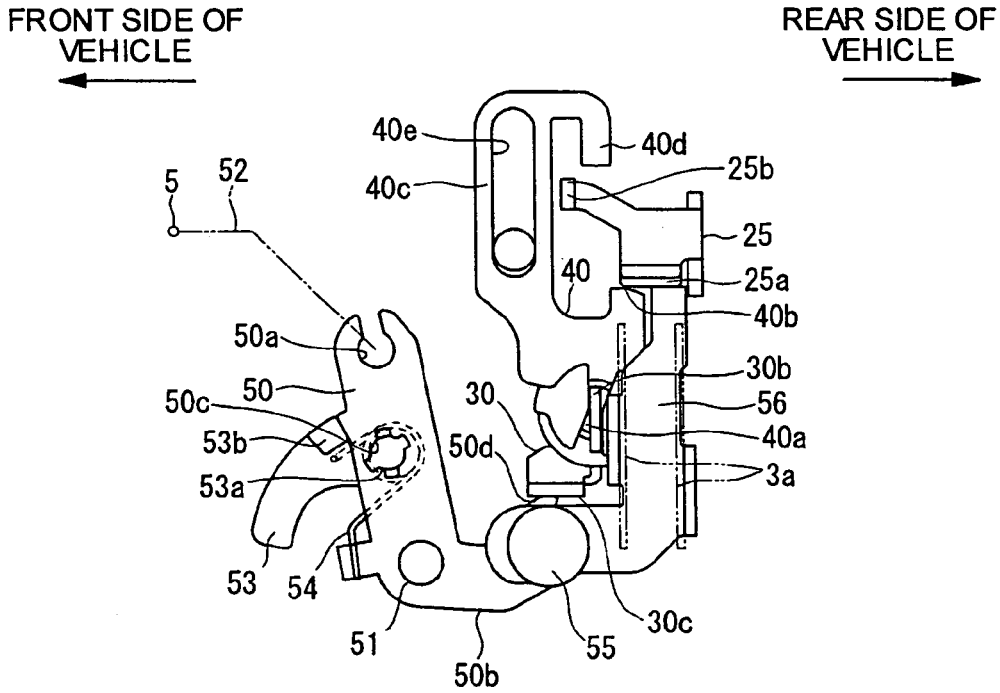
FIG. 6B is a conceptual view representing a relationship between the inner handle lever and the link lever when the inside handle lever is operated for opening.

The one-motion link 56 will come into abutment with the abutting unit 25*a* of the ratchet lever 25 to push the same when the inner handle lever 50 is swung counterclockwise in FIGS. 6A and 6B and has a nearly L shape. In other words, the one-motion link 56 extends (upward) to the abutting unit 25*a* of the ratchet lever 25 after extending in an outward radial direction from the rivet 55 to the rear side of the vehicle.

Also the proximal end of the one-motion link 56 is formed with a coupling slot (not shown) which allows sliding with respect to the rivet 55. Furthermore, a guide 3*a* for guiding an extension in the one-motion link 56 that extends toward the abutting unit of the ratchet lever is formed in the sub casing 3.

The lock mechanism 600 is switchable between an unlock state wherein rotational operation of the open lever 30 caused by a door-opening operation of the outside handle 1 is transmitted to the latch mechanism 20 and a lock state wherein rotational operation of the open lever 30 caused by a door-opening operation of the outside handle 1 is not transmitted to the latch mechanism 20, and includes a key lever 610, a key sub lever 620, a connect lever 630, a sector gear 650, a panic lever 660 and a warm wheel 670 in a surface of the main casing 2 which surface opposes the sub casing 3, or in a surface covered with the sub casing 3 in the main casing 2.

Figure 7A:
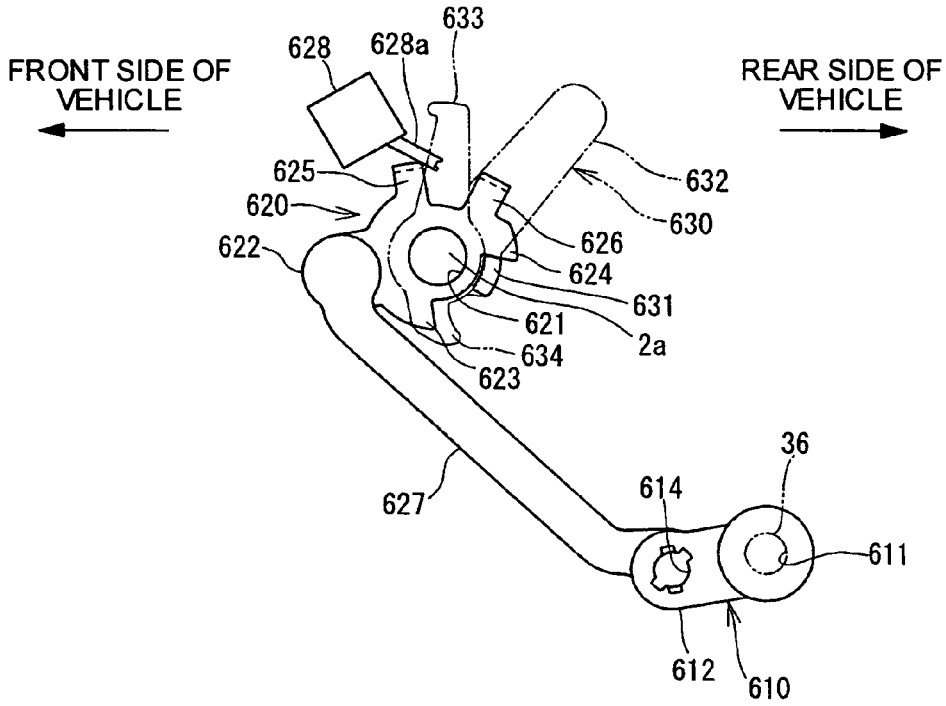
FIG. 7A is a conceptual view representing a lock mechanism switched into an unlock state by key operation.
Figure 7B:
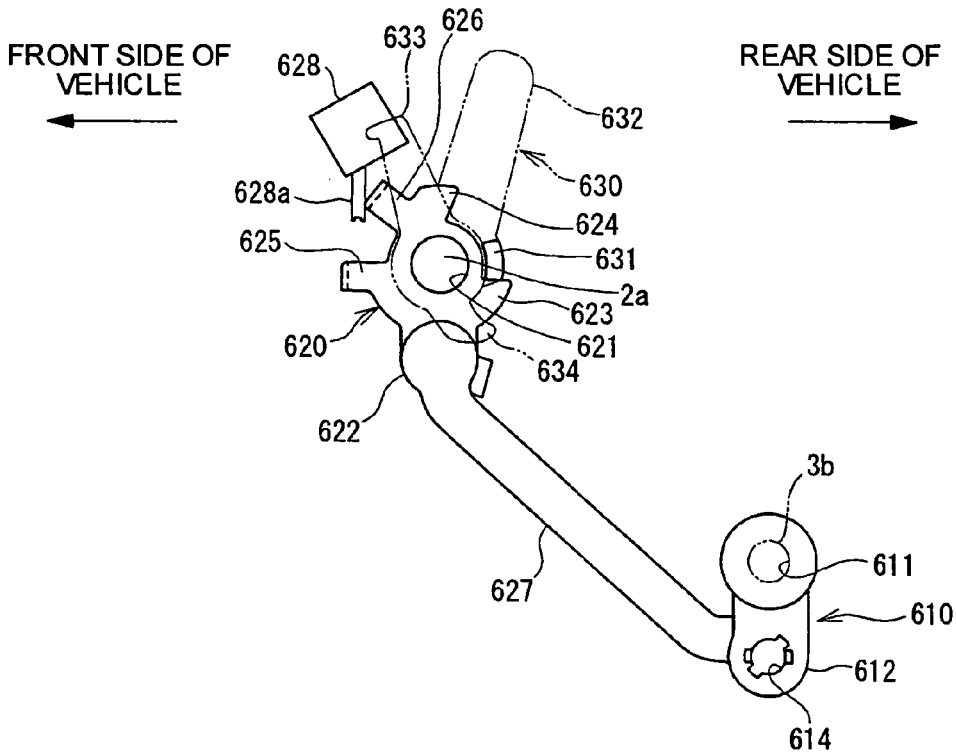
FIG. 7B is a conceptual view representing the lock mechanism switched into a lock state by key operation.

As shown in FIGS. 7A and 7B, the key lever 610 is rotatably disposed below the housing 10. The key lever 610 has an input shaft (not shown), a rotation recess 611 and a lever unit 612, and is rotatable by letting an input shaft unit (not shown) penetrate through a hole portion (not shown) formed in the main casing and fitting the rotational recess 611 with a projection 3*b* formed in the sub casing 3.

An input shaft unit (not shown) of the key lever 610 serves as an operation input portion from a key cylinder KC disposed in the door D, and is connected with a key cylinder linking unit 613 (see FIG. 1) such as link or cable. More specifically, the key cylinder linking unit 613 is connected in such a manner that when the key cylinder KC is operated for locking, the key lever 610 rotates counterclockwise in FIGS. 7A and 7B and when the key cylinder KC is operated for unlocking, the key lever 610 rotates clockwise in FIGS. 7A and 7B.

The lever unit 612 extends in an outward radial direction of the input shaft unit, and is formed with a key link coupling hole 614 at its distal end.

Upper and front side of the vehicle from the key lever 610, a key sub lever 620 is rotatably disposed. The key sub lever 620 has a rotation hole 621, a key link coupling unit 622, a lock switching projection 623, an unlock switching projection 624, a lock operation recognizing projection 625 and an unlock operation recognizing projection 626. Through the rotation hole 621 a projection 2*a* formed in the main casing 2 penetrates to allow rotation of the key sub lever 620. The key link coupling unit 622 extends in an outward radial direction from the axial center of the rotation hole 621, and formed at its distal end with a key link coupling hole 622*a* (see FIGS. 8A and 8B). In turn, the key link coupling hole 614 of the key lever 610 and the key link coupling hole 622*a* of the key sub lever 620 are linked with a key link 627 whereby rotational operation of the key lever 610 can be transmitted to the key sub lever 620.

Both the lock switching projection 623 and the unlock switching projection 624 are formed to extend in an outward radial direction from the axial center of the rotation hole 621. The lock mechanism 600 is switched from an unlock state to a lock state by the lock switching projection 623, while the lock mechanism 600 is switched from a lock state to an unlock state by the unlock switching projection 624.

Both the lock operation recognizing projection 625 and the unlock operation recognizing projection 626 are formed to extend in an outward radial direction from the axial center of the rotation hole 621. When the key sub lever 620 is switched from an unlock state to a lock state, the lock operation recognizing projection 625 brings a detection piece 628*a* of a switch 628 down clockwise, while when the key sub lever 620 is switched from a lock state to an unlock state, the unlock operation recognizing projection 626 brings the detection piece 628*a* of the switch 628 down counterclockwise, whereby operation of the key cylinder KC, namely whether locking operation or unlocking operation is discriminated.

The connect lever 630 is rotatably mounted coaxially with the rotation hole 621 of the key sub lever 620, and has a switching projection 631, a sector gear coupling unit 632, a switch lever 633, a one-motion projection 634, and a rotational shaft unit 635.

The switching projection 631 is a projection that switches the connect lever 630 from an unlock state to a lock state, as well as from a lock state to an unlock state, and has a surface opposing the key sub lever 620. More specifically, the switching projection 631 is abuttable with the lock switching projection 623 and the unlock switching projection 624 of the key sub lever 620. And when the switching projection 631 comes into abutment with the lock switching projection 623 to push the switching projection 631, the connect lever 630 is switched from an unlock state to a lock state; while when the switching projection 631 comes into abutment with the unlock switching projection 624 to push the switching projection 631, the connect lever 630 is switched from a lock state to an unlock state.

The sector gear coupling unit 632 is a portion extending in an outward radial direction from the rotation center of the connect lever 630, and has a coupling projection 636 at its distal end. The coupling projection 636 extends nearly horizontally along the right-and-left direction of the vehicle body from the face located on the interior side in the distal end of the sector gear coupling unit 632.

Figure 8A:
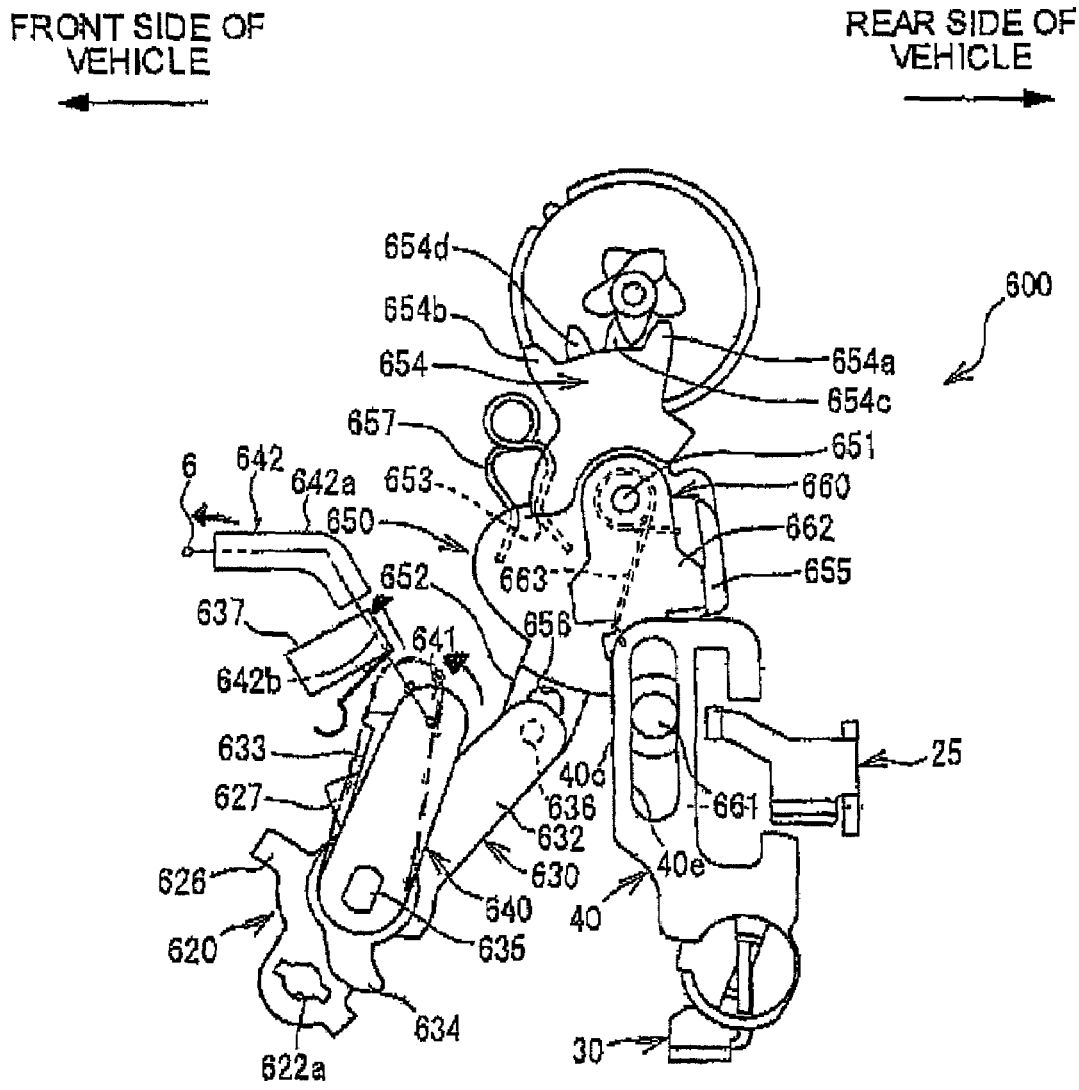
FIG. 8A is a conceptual view representing a lock mechanism when a lock lever is switched from an unlock state to a lock state.
Figure 8B:
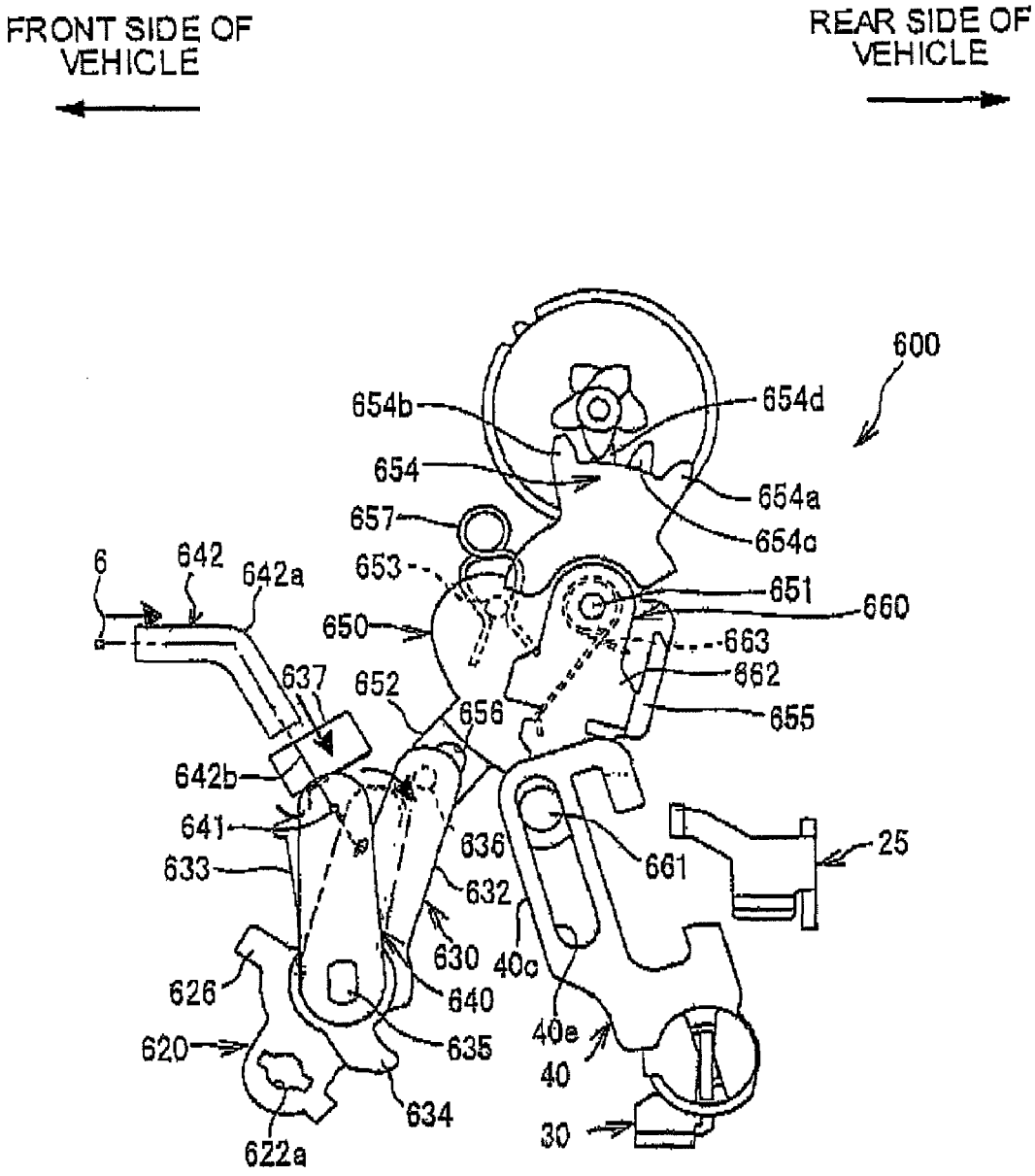
FIG. 8B is a conceptual view representing a lock mechanism when a lock lever is switched from a lock state to an unlock state.

The switch lever 633 is intended for detection of position of the connect lever 630, and turns off a switch 637 when the connect lever 630 is in an unlock state (see FIG. 8A), and turns on the switch 637 when the connect lever 630 is switched into a lock state (see FIG. 8B).

The one-motion projection 634 switches the lock mechanism 600 in a lock state into an unlock state by abutment with the above one-motion lever 53. The one-motion projection 634 is formed in an outward radial direction from the rotation center of the connect lever 630 so that it is in a position that allows abutment with the one-motion lever 53 when the lock mechanism 600 is in a lock state, and it is in a position that prevents abutment with the one-motion lever 53 when the lock mechanism 600 is in an unlock state.

The rotational shaft unit 635 is a portion that rotatably bears the connect lever 630 with respect to the sub casing 3, and the rotational shaft unit 635 penetrates the sub casing 3 and protrudes from housing 10. The rotational shaft unit 635 is fixedly attached in its protruding end, with a lock lever 640. The lock lever 640 rotates integrally with the connect lever 630 in such a manner that when the connect lever 630 shifts from a lock state to an unlock state, the lock lever 640 shifts from a lock state to an unlock state, whereas when the connect lever 630 shifts from an unlock state to a lock state, the lock lever 640 shifts from an unlock state to a lock state. Likewise, when the lock lever 640 shifts from an unlock state to a lock state, the connect lever 630 shifts from an unlock state to a lock state, ad when the lock lever 640 shifts from a lock state to an unlock state, the connect lever 630 shifts from a lock state to an unlock state.

The lock lever 640 has a button coupling unit 641. This button coupling unit 641 extends in an outward radial direction from the rotational shaft unit of the connect lever, and this button coupling unit 641 is connected with a wire cable 642 for linkage between the inside lock button 6 disposed on the interior side of the door D.

The wire cable 642 has an outer tube 642*a* and an inner wire 642*b*. The outer tube 642*a* is attached at its one end to a wire cable attaching unit 3*c* formed in the sub casing 3, and fixed at its other end near the inside lock button 6. Through this outer tube 642*a* the inner wire 640*b* penetrates. The inner wire 642*b* is connected at its one end with the button coupling unit 641 of the lock lever 640 and connected at its other end with the inside lock button 6.

Therefore, when the inside lock button 6 is operated for locking (operated in such a manner that the inner wire 642*b* is drawn out from the outer tube 642*a* on the inside lock button 6 side), the inner wire 642*b* is drawn into the outer tube 642*a* on the lock lever 640 side, and the lock lever 640 rotates counterclockwise in FIG. 8A. As a result, the lock lever 640 shifis from an unlock state to a lock state, as shown in FIG. 8A. On the other hand, when the inside lock button 6 is operated for unlocking (operated in such a manner that the inner wire 642*b* is pushed into the outer tube 642*a* on the inside lock button 6 side), the inner wire 642*b* is pushed out of the outer tube 642*a* on the lock lever 640 side, and the lock lever 640 rotates clockwise in FIG. 8B. As a result, the lock lever 640 shifts from a lock state to an unlock state, as shown FIG. 8B.

The sector gear 650 is disposed in an upper part of the housing 10 to be able to swing via a gear shaft 651 extending nearly horizontally along the right-and-left direction of the vehicle, and has a connect lever coupling unit 652, a state keeping projection 653, a driven gear unit 654 and a panic lever abutting unit 655.

The connect lever coupling unit 652 extends in an outward radial direction of the gear shaft 651 and the connect lever coupling unit 652 is formed with a coupling slot 656. Through this coupling slot 656 a coupling projection 636 formed in the connect lever 630 penetrates, and the sector gear 650 swings clockwise as the connect lever 630 swings counterclockwise, and the sector gear 650 swings counterclockwise as the connect lever 630 swings clockwise.

The state keeping projection 653 is provided for keeping a rotational position of the sector gear 650, and extends nearly horizontal along the right-and-left direction of the vehicle, on the surface opposing the main casing. The state keeping projection 653 keeps an unlock state (FIG. 8A) or a lock state (FIG. 8B) by being sandwiched with a spring 657 attached to the main casing.

The driven gear unit 654 is formed in a fan shape about the gear shaft 651, as shown in FIGS. 8A and 8B, and has a pair of outside teeth 654*a*, 654*b*, a first receiving tooth 654*c*, and a second receiving tooth 654*d* on its outer circumference. These pair of outside teeth 654*a*, 654*b*, first receiving tooth 654*c*, and second receiving tooth 654*d* are provided at height positions of different three levels with respect to the extending direction of the gear shaft 651. The pair of outside teeth 654*a*, 654*b* are provided on each side of the driven gear unit 654, and disposed at innermost position toward the interior. The first receiving tooth 654*c* is disposed between the pair of outside teeth 654*a*, 654*b* to be adjacent to one outside tooth 654*a*, and situated at a middle position along the extending direction of the gear shaft 651. The second receiving tooth 654*d* is disposed between the other outside tooth 654*b* and the first receiving tooth 654*c*, and situated at the outermost position toward the exterior.

The panic lever abutting unit 655 is formed to project from an edge on the rear side of the vehicle of the sector gear 650 toward the interior.

The panic lever 660 connects the sector gear 650 and the link lever 40, and is rotatably attached to the gear shaft 651. The panic lever 660 extends downward in an outward radial direction from the gear shaft 651, and is provided with a coupling projection 661 and a sector gear abutting unit 662. The coupling projection 661 is a cylindrical portion that projects nearly horizontally along the right-and-left direction of the vehicle body from the surface on the interior side in a distal end portion of the panic lever 660, and is attached to the coupling slot 40*e* of the link lever 40. The sector gear abutting unit 662 is a step portion formed on the rear side of the vehicle in an intermediate part of the panic lever 660, and is able to abut with and operably linked with the panic lever abutting unit 655 of the sector gear 650. Between the sector gear 650 and the panic lever 660 is provided a panic spring 663 which urges the sector gear abutting unit 662 of the panic lever 660 to abut with the lever abutting unit 655 of the sector gear 650.

The warm wheel 670 is disposed above the sector gear 650, to be able to rotate via a warm shaft 671 extending nearly horizontal along the right-and-left direction of the vehicle body. And this warm wheel 670 is coaxially and fixedly attached with an intermittent gear 672. The intermittent gear 672 has a basic tooth 672*a*, a pair of first driving teeth 672*b* and a pair of second driving teeth 672*c*, and forms a one-directional force transmitting unit between the pair or outside teeth 654*a*, 654*b*, the first receiving tooth 654*c*, and the second receiving tooth 654*d* provided in the driven gear unit 654 of the sector gear 650. More specifically, the basic tooth 672*a*, the pair of first driving teeth 672*b*, and the pair of second driving teeth 672*c* of the intermittent gear 672 are provided at height positions of different three levels with respect to the extending direction of the warm shaft 671, as is the case with the pair of outside teeth 654*a*, 654*b*, the first receiving tooth 654*c*, and the second receiving tooth 654*d* of the driven gear unit 654, in such a manner that the basic tooth 672*a* meshes only with the outside teeth 654*a*, 654*b*, the first driving tooth 672*b* meshes only with the first receiving tooth 654*c*, and the second driving tooth 672*c* meshes only with the second receiving tooth 654*d*. Although not clearly illustrated, between the warm wheel 670 and the main casing 2 is provided a neutral return spring for keeping the basic tooth 672*a* in the intermittent gear 672 of the warm wheel 670 directed to the axial center of the gear shaft 651 (hereinafter, "neutral state").

When the sector gear 650 is rotated clockwise from the position shown in FIG. 9A (hereinafter, "unlock position") to the position shown in FIG. 9B (hereinafter, "lock position"), each of the teeth 654*a*, 654*b*, 654*c*, and 654*d* in the driven gear unit 654 of the sector gear 650 no longer meshes with any teeth 672*a*, 672*b*, and 672*c* of the intermittent gear 672, so that the warm wheel 670 will not be rotated.

Likewise, when the sector gear 650 rotates counterclockwise from a lock position to an unlock position, the warm wheel 670 will not rotate.

Figure 9A:
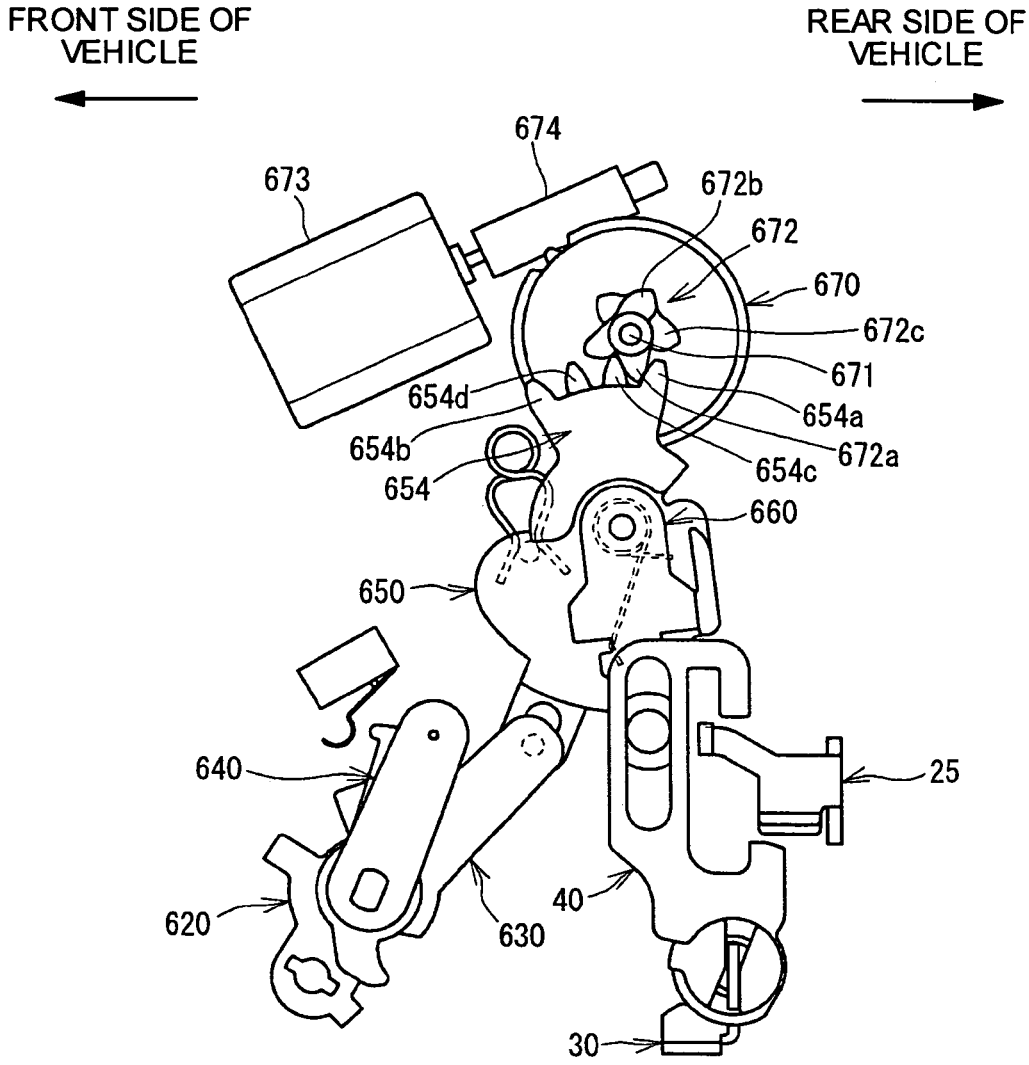
FIG. 9A is a conceptual view representing a lock mechanism switched into an unlock state by a keyless entry system.
Figure 9B:
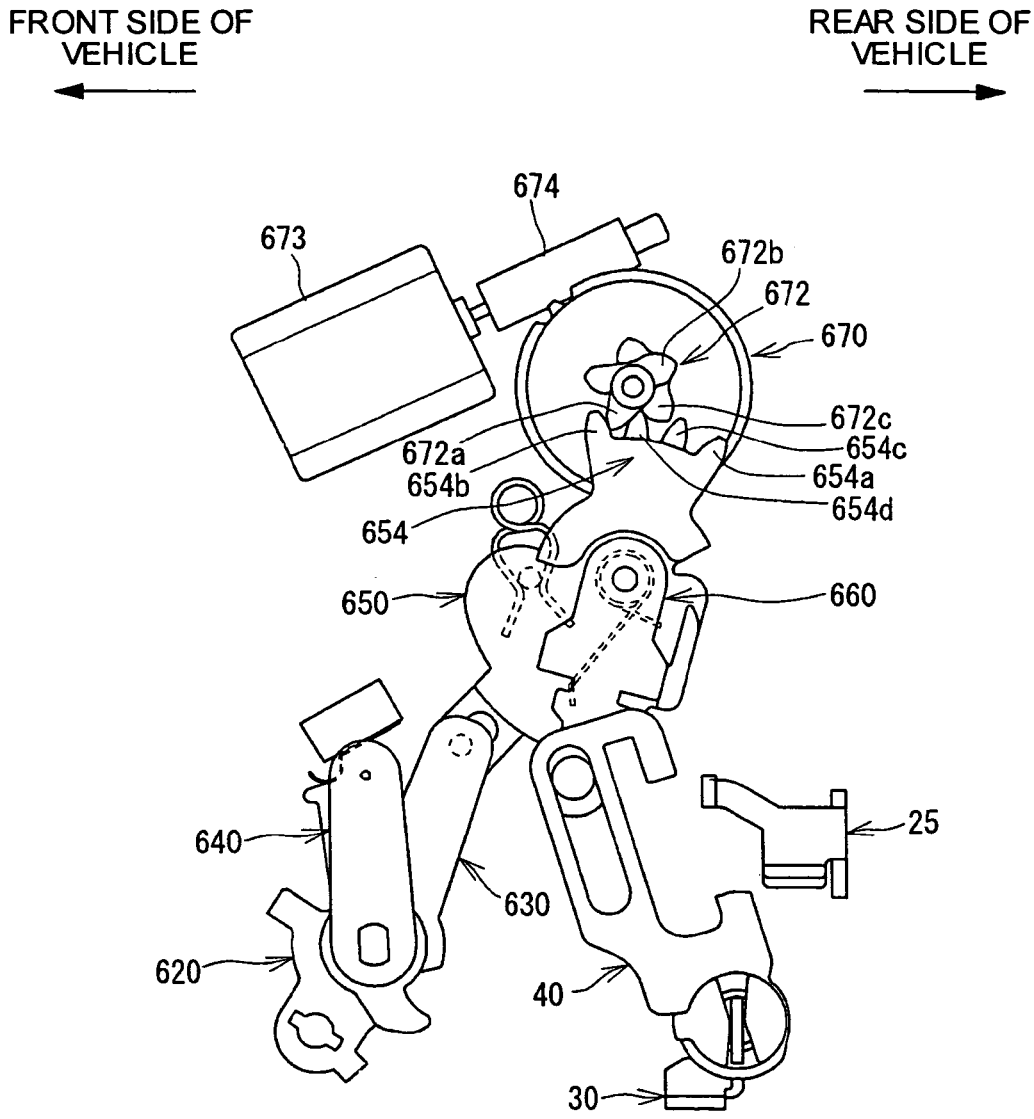
FIG. 9B is a conceptual view representing a lock mechanism switched into a lock state by a keyless entry system.

As shown in FIGS. 9A and 9B, the warm wheel 670 is meshed with a warm 674 fixedly attached to an output shaft of a driving motor 673.

When the warm wheel 670 is rotated counterclockwise from the state shown in FIG. 9A, the basic tooth 672*a* comes into mesh with the outside tooth 654*a*, secondly the first driving tooth 672*b* comes into mesh with the first receiving tooth 654*c*, and then the second driving tooth 672*b* comes into mesh with the second receiving tooth 654*d*, whereby the link lever 40 is rotated counterclockwise via the driven gear unit 654 to be displaced to a lock position (see FIG. 9B). After displacing the link lever 40 from an unlock position to a lock position by way of rotation of the warm wheel 670, the link lever 40 can no longer be rotated by the intermittent gear 672, so that the warm wheel 670 returns to its neutral state by elastic resilience of a neutral return spring (not shown) without rotation of the link lever 40.

Likewise, when the warm wheel 670 is rotated clockwise from the state shown in FIG. 9B, the first basic tooth 672*a* comes into mesh with the outside tooth 654*b*, secondly the second driving tooth 672*c* comes into mesh with the second receiving tooth 654*d*, and the first driving tooth 672*b* comes into mesh with the first receiving tooth 654*c*, whereby the link lever 40 is rotated clockwise via the driven gear unit 654 to be displaced to an unlock position (see FIG. 9A). After displacing the link lever 40 from a lock position to an unlock position by way of rotation of the warm wheel 670, the link lever 40 can no longer be rotated by the intermittent gear 672, so that the warm wheel 670 returns to its neutral state by elastic resilience of a neutral return spring (not shown) without rotation of the link lever 40.

In the lock mechanism 600 configured as described above, when it is in an unlock state, as shown in FIG. 5A and FIG. 6A, the ratchet driving unit 40*b* of the link lever 40 is placed below the abutting unit 25*a* in the ratchet lever 25.

In this unlock state, when the outside handle 1 is operated for opening the door, and the open lever 30 is rotated counterclockwise in FIG. 5A, the ratchet driving unit 40*b* of the link lever 40 pushes the abutting unit 25*a* of the ratchet lever 25 to move it upward as the opening operation end 30*b* moves upward, as shown in FIG. 5B. As a result, the hook unit 21*b* of the latch 21 and engaging unit 22*a* of the ratchet 22 are released from abutting engagement, enabling the door D to be operated relative to the vehicle body.

In this unlock state, when the inside handle 5 is operated for opening the door, and the inner handle lever 50 is rotated counterclockwise in FIG. 6A, the one-motion link 56 moves upward to push the abutting unit 25*a* of the ratchet lever 25 upward, as shown in FIG. 6B. As a result, the hook unit 21*b* of the latch 21 and the engaging unit 22*a* of the ratchet 22 are released from abutting engagement, enabling the door D to be operated relative to the vehicle body.

When the door D is in an open state, it is impossible to lock the door lock device only by locking the inside lock button 6. This is because, when the door D is in an open sate, in other words, when the latch 21 and the ratchet 22 are not in abutting engagement with each other, the operation end 25*b* of the ratchet lever 25 and the lock preventing unit 40*d* of the link lever 40 are adjacent to each other, so that the operation end 25*b* of the ratchet lever 25 prevents the link lever 40 from swinging.

However, in an open state of the door D, when the inside lock button 6 is operated for locking while the outside handle 1 or the inside handle 5 is being operated for opening the door, the door lock device can be locked. This is because even in an open state of the door D, the link lever 40 moves upward through door opening operation of the outside handle 1 or the inside handle 5 to cancel the adjacent relation between the operation end 25*b* of the ratchet lever 25 and the lock preventing unit 40*d* of the link lever 40, so that operation end 25*b* of the ratchet lever 25 no longer prevents the link lever 40 from swinging.

In an open state of the door D, when the inside lock button 6 is operated for unlocking while the inside handle 5 is being operated for opening the door, the one-motion projection 634 pushes the one-motion lever 53 as the connect lever 630 rotates, and rotates counterclockwise about the one-motion lever coupling hole 50*c* against the urging force of the one-motion spring 54. Thereafter, when the door opening operation of the inside handle 5 is suspended, the one-motion lever 53 rotates clockwise about the one-motion lever coupling hole 50*c* by the urging force of the one-motion spring 54 to return to its original position, while the door lock device is kept in a lock state.

On the other hand, in a closed state of the door D, when the inside lock button 6 in an unlock state is operated for locking, the connect lever 630 swings counterclockwise as the lock lever 640 rotates to cause the coupling projection 636 and the sector gear 650 coupled via the coupling slot 656, to swing clockwise. As the sector gear 650 swings clockwise, the panic lever abutting unit 655 of the sector gear 650 pushes the sector gear abutting unit 662 of the panic lever 660, so that the panic lever 660 rotates clockwise. This rotation of the panic lever 660 in turn causes the link lever 40 to swing counterclockwise, rendering the lock mechanism 600 in a lock state as shown in FIG. 8B.

In this lock state, even if the outside handle 1 is operated for opening the door, and the open lever 30 is rotated clockwise in FIG. 1, the ratchet driving unit 40*b* of the link lever 40 and the abutting unit 25*a* of the ratchet lever 25 will not come into abutment with each other, and the abutting engagement between the hook unit 21*b* of the latch 21 and the engaging unit 22*a* of the ratchet 22 will not be cancelled. As a result, the door D is kept in closed state relative to the vehicle body, enabling the vehicle to be locked.

Transition from the unlock state shown in FIG. 8A to the lock state shown in FIG. 8B is not necessary achieved by locking operation of the inside lock button 6, but may be achieved by clockwise rotation of the sector gear 650 by rotating the warm wheel 670 counterclockwise by means of the driving motor 673 as shown in FIG. 9B, or may be achieved by counterclockwise rotation of the key sub lever 620 by operating the key cylinder KC as shown in FIG. 7B.

When the inside lock button 6 is operated for unlocking from the aforementioned lock state, the connect lever 630 swings clockwise as the lock lever 640 rotates, to cause the coupling projection 636 and the sector gear 650 coupled via the coupling slot 656, to swing counterclockwise. As the sector gear 650 swings counterclockwise, the panic lever 660 urged by the panic spring 663 rotates counterclockwise in conjunction with the sector gear 650, and as the panic lever 660 further rotates, the link lever 40 swings clockwise to render the lock mechanism 600 in an unlock state as shown in FIG. 8A.

Furthermore, in a lock state, when the inside handle 5 is operated for opening the door, the lock state is switched into an unlock state to enable the door opening operation of the inside handle 5, and the door opening operation of the inside handle 5 is transmitted to the ratchet 22. Thus the door D is allowed to be opened.

Figure 10A:
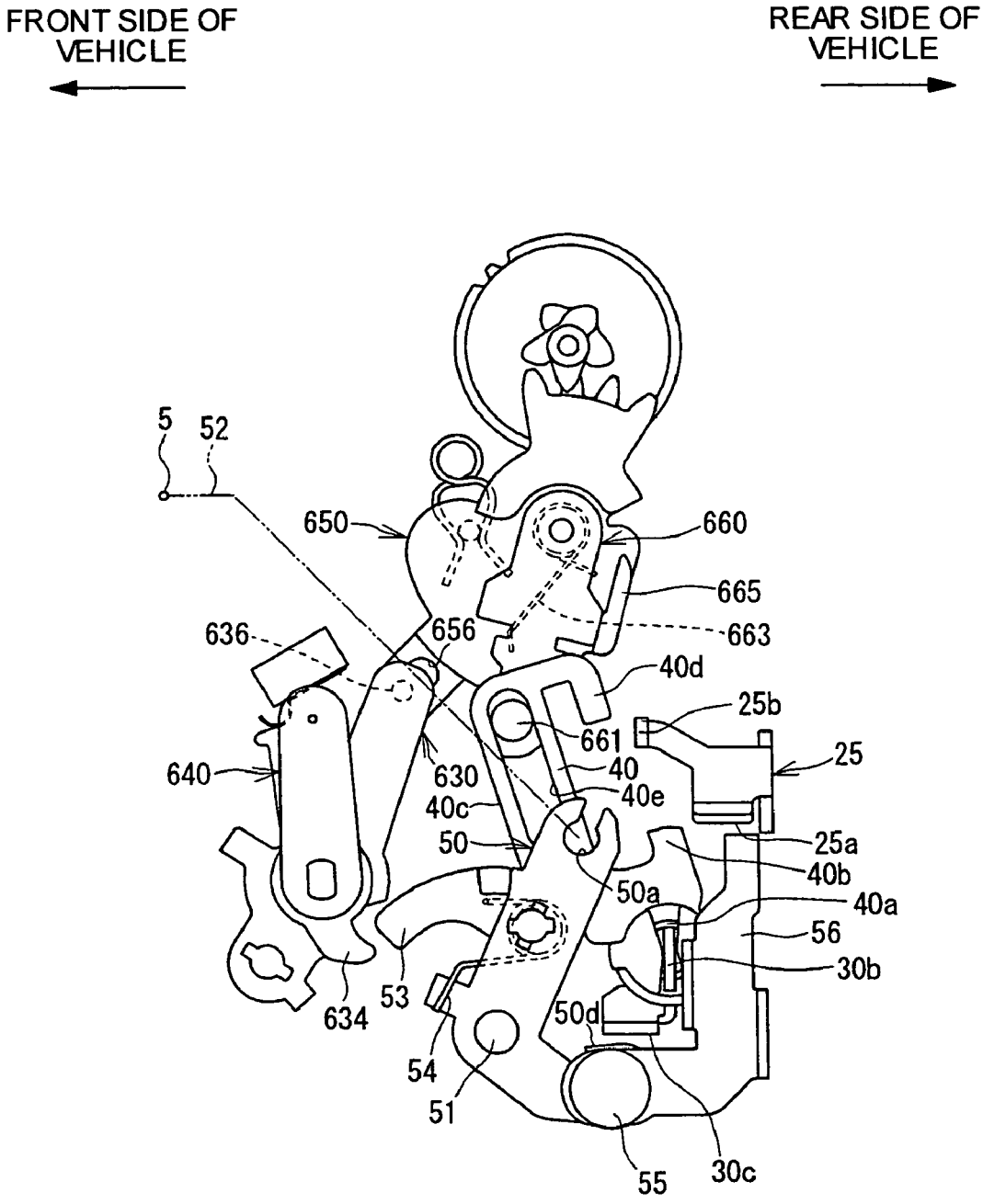
FIG. 10A is a conceptual view representing a lock mechanism in a lock state before operating the inside handle.
Figure 10B:
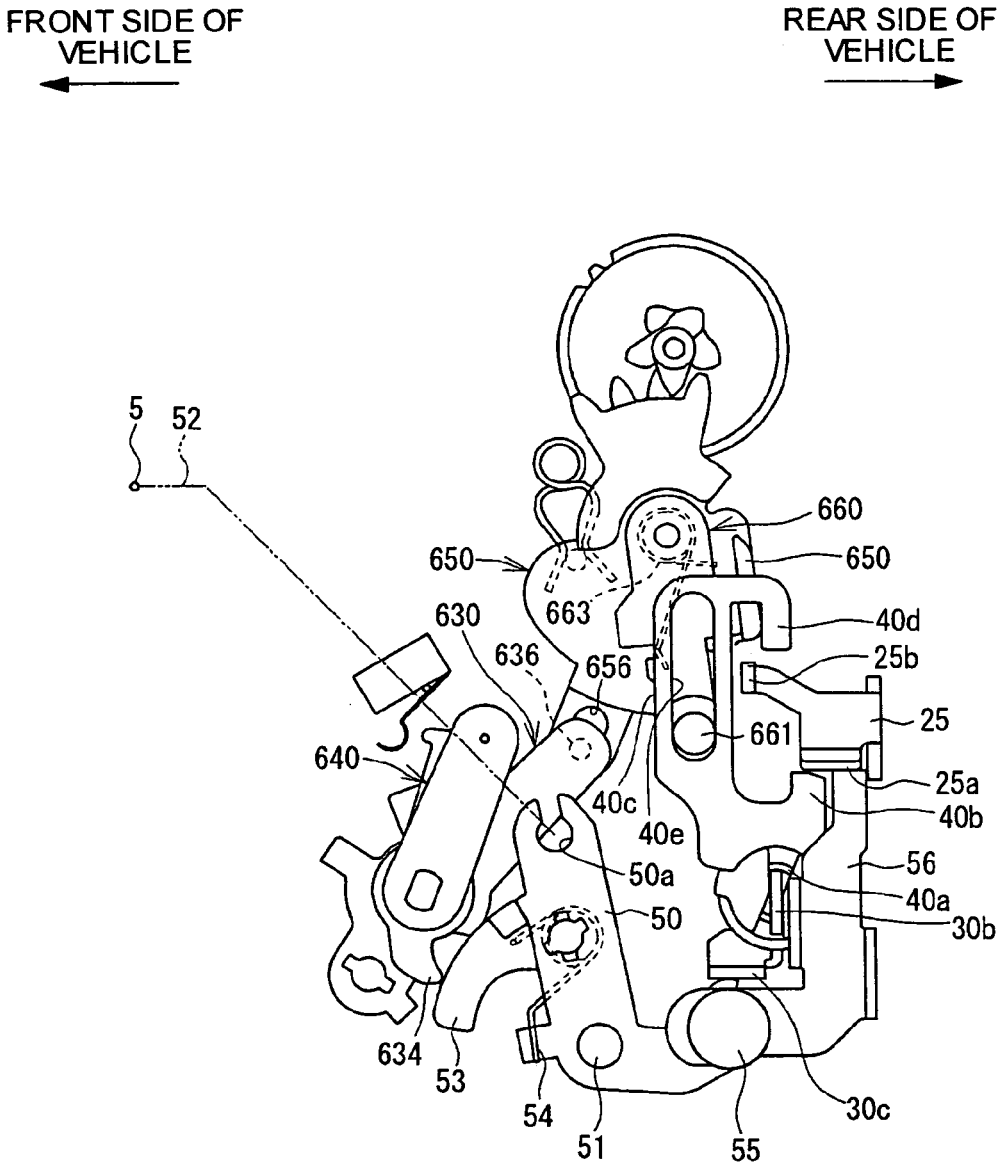
FIG. 10B is a conceptual view representing a lock mechanism switched into an unlock state by operating the inside handle.

Now more detailed description will be given. In the lock state shown in FIG. 10A, when the inside handle 5 is operated for opening the door, the inner handle lever 50 swings counterclockwise. Due to this swing of the inner handle lever 50, the one-motion lever 53 that rotates integrally with the inner handle lever 50 pushes the one-motion projection 634 of the connect lever 630 to cause the connect lever 630 to swing clockwise. With this swing, the sector gear 650 swings counterclockwise, and the panic lever urged by the panic spring 663 rotates counterclockwise in conjunction with the sector gear 650. With this rotation of the panic lever 660, the link lever 40 swings clockwise to switch the lock mechanism 600 into the unlock state shown in FIG. 10B. On the other hand, as the inner handle lever 50 swings counterclockwise, the one-motion link 56 pushes the abutting unit 25*a* of the ratchet lever 25, allowing the abutting engagement state between the hook unit 21*b* of the latch 21 and the engaging unit 22*a* of the ratchet 22 to be cancelled and allowing door opening operation.

Transition from the lock state shown in FIG. 8B to the unlock state shown in FIG. 8A is not necessarily achieved by unlocking operation of the inside lock button 6 or operation of the inside handle 5, but may be achieved by clockwise rotation of the sector gear 650 by rotating the warm wheel 670 clockwise by means of the driving motor 673 as shown in FIG. 9A, or may be achieved by clockwise rotation of the key sub lever 620 by operating the key cylinder KC as shown in FIG. 7A.

According to the door lock device configured as described above, since the one-motion lever 53 attached to the inner handle lever 50 displaces the link lever 40 from a lock position (see FIG. 10A) to an unlock position (see FIG. 10B) by the door opening operation by the inside handle 5, while the one-motion link 56 attached to the inner handle lever 50 transmits the door opening operation by the inside handle 5 to the ratchet lever 25, an advantage is obtained that the one-motion function can be realized. In addition, since the door opening operation by the inside handle 5 is transmitted to the ratchet lever 25 via the one-motion link 56 regardless of the link lever 40, it is possible to arbitrarily set the timing that the link lever 40 displaces from a lock position to an unlock position and the timing that the one-motion link 56 transmits the door opening operation by the inside handle 5 to the ratchet lever 25. Therefore, even in the case of a door lock device having so-called one-motion function, it is possible to set the lock canceling timing and the door opening timing in consideration of the operation feeling, which is an advantage of the invention.

Since the link lever 40 can be securely displaced from a lock position to an unlock position by door opening operation by the inside handle 5, while the door opening operation can be securely transmitted to the ratchet lever 25 by means of the one-motion link 56, such a situation will never occur that door opening operation by inside handle 5 fails to be transmitted to the ratchet lever 25 despite the lock state of the lock mechanism 600 is cancelled.

When the inside lock button 6 is operated for locking, the inner wire 642*b* of the wire cable 642 is drawn into the outer tube 642*a* of the wire cable 642 to make the lock lever 640 shift from an unlock state to a lock state. On the other hand, when the inside lock button 6 is operated for unlocking, the inner wire 642*b* of the wire cable 642 is pushed out of the outer tube 642*a* of the wire cable 642 to make the lock lever 640 shift from a lock state to an unlock state. Therefore, if a pulling action is given on the inner wire 642*b* of the wire cable 642 by pulling or pushing the wire cable 642 all together with the outer tube 642*a* by some means, the lock mechanism 600 will not transit from a lock state to an unlock state. As a result, a door lock device having antitheft ability is achieved, which is an advantage of the invention.

According to the door lock device of the present invention, when the inside lock button is operated for locking, the inner wire of the wire cable is drawn into the outer tube of the wire cable, and the lock lever shifts from an unlock state to a lock state, whereas when the inside lock button is operated for unlocking, the inner wire of the wire cable is pushed out of the outer tube of the wire cable, and the lock lever shifts from a lock state to an unlock state. Therefore, even when a drawing action is exerted on the inner wire of the wire cable by pulling or pushing the wire cable integrally with the outer tube from outside of the door by some means, the lock mechanism will not transit from a lock state to an unlock state. This is advantageous in that a door lock device having excellent antitheft ability is realized.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A door lock device comprising:

a ratchet lever that is engaged with a ratchet that is in abutting engagement with a latch, and releases the abutting engagement;

a lock lever that shifts between an unlock position where transmission of a door opening operation by an outside handle to the ratchet lever is enabled and a lock position where the transmission of the door opening operation by the outside handle to the ratchet lever is disabled; and an inside lock button connected to an inner wire of a wire cable that causes the lock lever to shift from the unlock position to the lock position with an operation of locking, and causes the lock lever to shift from the lock position to the unlock position with an operation of unlocking, wherein the lock lever is connected to the wire cable, and wherein when the inside lock button is operated for locking, the inner wire of the wire cable is drawn into an outer tube of the wire cable, and the connection between the lock lever and the wire cable is drawn toward the inside lock button so that the lock lever shifts from the unlock state to the lock state, and when the inside lock button is operated for unlocking, the inner wire of the wire cable is pushed out of the outer tube of the wire cable so that the connection between the lock lever and the wire cable is pushed away from the inside lock button so that the lock lever shifts from the lock state to the unlock state;

further comprising a connect lever, a link lever, wherein the connect lever rotates with the lock lever, and wherein rotation of the connect lever causes the unlock state; and wherein the rotation of the connect lever causes rotation of the link lever to a position in the unlock state whereby the link lever is capable of rotating the ratchet lever.

2. The door lock device of claim 1, further comprising a switch and switch lever that rotates with the lock lever; wherein when the lock lever is in the lock state, the switch lever turns on the switch, and when the lock lever is in the unlock state, the switch lever turns off the switch.

3. A door lock device comprising:

a ratchet lever that is engaged with a ratchet that is in abutting engagement with a latch, and releases the abutting engagement;

a lock lever that shifts between an unlock position where transmission of a door opening operation by an outside handle to the ratchet lever is enabled and a lock position where the transmission of the door opening operation by the outside handle to the ratchet lever is disabled; and an inside lock button connected to an inner wire of a wire cable that causes the lock lever to shift from the unlock position to the lock position with an operation of locking, and causes the lock lever to shift from the lock position to the unlock position with an operation of unlocking, wherein the lock lever is connected to the wire cable, and wherein when the inside lock button is operated for locking, the inner wire of the wire cable is drawn into an outer tube of the wire cable, and the connection between the lock lever and the wire cable is drawn toward the inside lock button so that the lock lever shifts from the unlock state to the lock state, and when the inside lock button is operated for unlocking, the inner wire of the wire cable is pushed out of the outer tube of the wire cable so that the connection between the lock lever and the wire cable is pushed away from the inside lock button, further comprising:

a motion lever that rotates upon operation of an inside handle; and a motion projection that rotates with the lock lever, wherein the motion projection is positioned to enable the one-motion projection to abut the motion lever upon rotation of the motion lever in the lock state, thereby shifling the lock state to the unlock state.

4. The door lock device of claim 3, wherein the motion lever is arc-shaped.

5. The door lock device of claim 3, further comprising a motion spring that urges an abutment unit of the motion lever toward an inside handle lever.

* * * * *